US009761973B2

(12) United States Patent
Tsai et al.

(10) Patent No.: US 9,761,973 B2
(45) Date of Patent: Sep. 12, 2017

(54) REINFORCED ELECTRICAL RECEPTACLE CONNECTOR

(71) Applicant: ADVANCED-CONNECTEK INC., New Taipei (TW)

(72) Inventors: Yu Lun Tsai, New Taipei (TW); Pin Yuan Hou, New Taipei (TW); Chung Fu Liao, New Taipei (TW); Rui Su, New Taipei (TW); Long Fei Chen, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/293,250

(22) Filed: Oct. 13, 2016

(65) Prior Publication Data

US 2017/0110817 A1 Apr. 20, 2017

(30) Foreign Application Priority Data

Oct. 20, 2015 (CN) ..... 2015 1 0677720

(51) Int. Cl.

| | |
|---|---|
| ***H01R 12/71*** | (2011.01) |
| ***H01R 13/516*** | (2006.01) |
| ***H01R 13/6585*** | (2011.01) |
| ***H01R 24/60*** | (2011.01) |
| ***H01R 13/6595*** | (2011.01) |
| *H01R 107/00* | (2006.01) |
| *H01R 12/72* | (2011.01) |
| *H01R 13/405* | (2006.01) |

(52) U.S. Cl.

CPC ..... *H01R 12/716* (2013.01); *H01R 13/516* (2013.01); *H01R 13/6585* (2013.01); *H01R 13/6595* (2013.01); *H01R 24/60* (2013.01); *H01R 12/72* (2013.01); *H01R 13/405* (2013.01); *H01R 2107/00* (2013.01)

(58) Field of Classification Search

CPC H01R 13/504; H01R 13/658; H01R 13/6585; H01R 13/6587; H01R 13/6592; H01R 13/6593; H01R 23/02; H01R 23/688; H01R 12/716; H01R 13/516; H01R 24/60

USPC ..... 439/607.05, 607.41, 607.46, 607.51, 439/607.55, 607.57, 660

See application file for complete search history.

(56) References Cited

U.S. PATENT DOCUMENTS

| | | | | |
|---|---|---|---|---|
| 9,484,677 | B2 * | 11/2016 | Guo | H01R 13/6585 |
| 9,502,821 | B2 * | 11/2016 | Little | H01R 13/6582 |
| 9,525,236 | B2 * | 12/2016 | Lee | H01R 13/5202 |

(Continued)

*Primary Examiner* — Tulsidas C Patel
*Assistant Examiner* — Travis Chambers
(74) *Attorney, Agent, or Firm* — Pai Patent & Trademark Law Firm; David Pai Chao-Chang

(57) ABSTRACT

A reinforced electrical receptacle connector has an insulated housing, a first terminal set, a second terminal set, a shielding plate and a shell. The insulated housing has a base and a tongue formed on the base. The shielding plate is embedded in the insulated housing and has two corner reinforcing tabs are formed on respectively on two front corners of the shielding plate. Each corner reinforcing tab has a front edge being flush with the front edge of the tongue and an outside edge being flush with one of the outside edges of the tongue. The shell accommodates the insulated housing. The front corners of the shielding plate are substantially hidden in the front corners of the tongue, which prevents inadvertent rupture at the front corners.

8 Claims, 11 Drawing Sheets

(56) References Cited

U.S. PATENT DOCUMENTS

| | | | | |
|---|---|---|---|---|
| 2016/0056586 | A1* | 2/2016 | Guo | H01R 13/41<br>439/607.05 |
| 2016/0104975 | A1* | 4/2016 | Guo | H01R 13/6585<br>439/607.05 |
| 2016/0104976 | A1* | 4/2016 | Yu | H01R 13/6585<br>439/607.05 |

* cited by examiner

REINFORCED ELECTRICAL RECEPTACLE CONNECTOR

BACKGROUND OF THE INVENTION

1. Field of the Invention

The present invention relates to an electrical connector, and more particularly to a reinforced electrical receptacle connector that improves corners of an insulative housing thereof to prevent rupture of the corners due to repetitive engagement of the reinforced electrical receptacle connector with corresponding electrical plug connectors. Therefore, the lifespan of the reinforced electrical receptacle connector is prolonged.

2. Description of Related Art

Electrical connectors are general electrical components on electronic devices widely used for connecting to other matching connectors on the other electrical devices. For example universal serial bus (USB) 3.1 connectors are conventional and products that are available and equipped in variety of electronic devices.

USB 3.1 protocol has been further developed to include USB Type C connector that is able to provide ultrahigh data transmission speed of 10 Gbps and has a light and compact structure especially suitable for portable devices. The USB Type C connector is also featured with a reversible socket for reversible connection for extensive applications on different electrical devices.

A USB type C receptacle connector has an insulative housing, two terminal sets and a metal shell. The insulative housing is made of plastic and has a tongue formed on and protrudes from the insulative housing. The terminal sets are mounted on the insulative housing, are able to transmit signals. The metal shell covers the insulative housing and the terminal sets.

However, after repeated engagements and disengagements of the USB type C receptacle connector and corresponding plug connectors, front corners of the tongue of the insulative housing cannot bear the engaging or disengaging force and are ruptured. The ruptured tongue cannot suffer further engagement or disengagement of the electrical receptacle and plug connectors. Therefore, the USB type C receptacle connector is broken.

To overcome the shortcomings, the present invention provides a reinforced electrical receptacle connector to mitigate or obviate the aforementioned problems.

SUMMARY OF THE INVENTION

The main objective of the invention is to provide a reinforced electrical receptacle connector that improves corners of an insulative housing thereof to prevent rupture of the corners due to repetitive engagement of the reinforced electrical receptacle connector with corresponding electrical plug connectors. Therefore, the lifespan of the reinforced electrical receptacle connector is prolonged.

The reinforced electrical receptacle connector in accordance with the present invention has an insulated housing, a first terminal set, a second terminal set, a shielding plate and a shell. The insulated housing has a base and a tongue formed on the base. The shielding plate is embedded in the insulated housing and has two corner reinforcing tabs are formed on respectively on two front corners of the shielding plate. Each corner reinforcing tab has a front edge being flush with the front edge of the tongue and an outside edge being flush with one of the outside edges of the tongue. The shell accommodates the insulated housing. The front corners of the shielding plate are substantially hidden in the front corners of the tongue, which prevents inadvertent rupture at the front corners.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
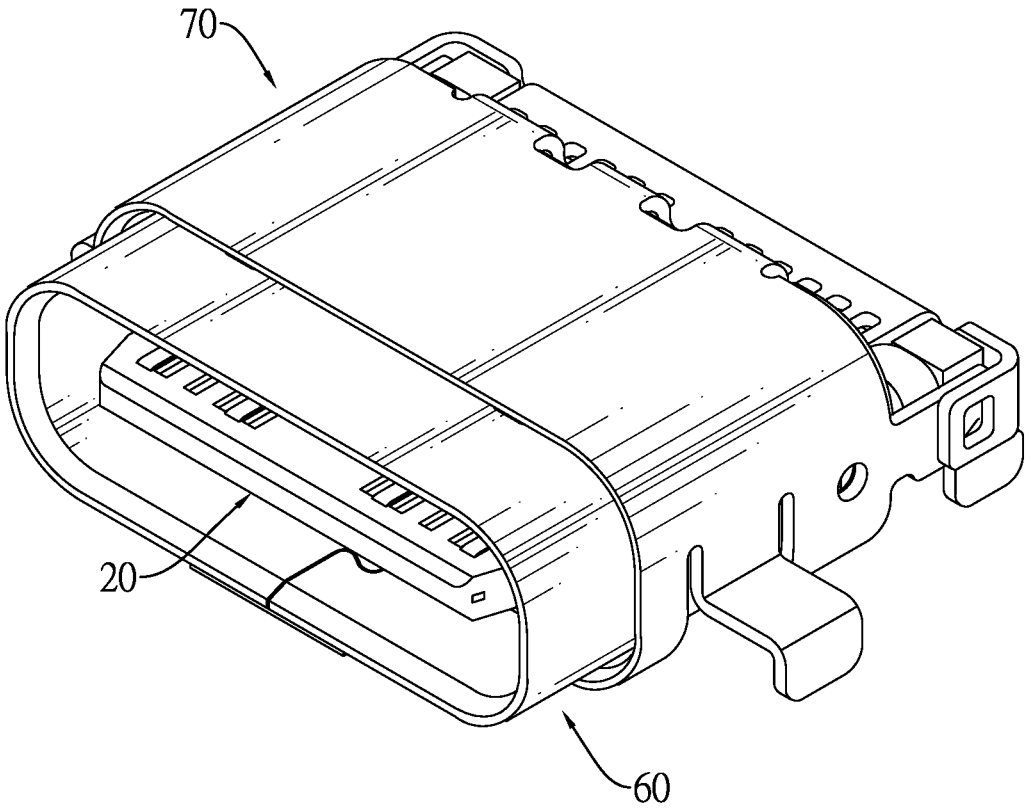
FIG. 1 is a perspective view of a reinforced electrical receptacle connector in accordance with the present invention.
Figure 8:
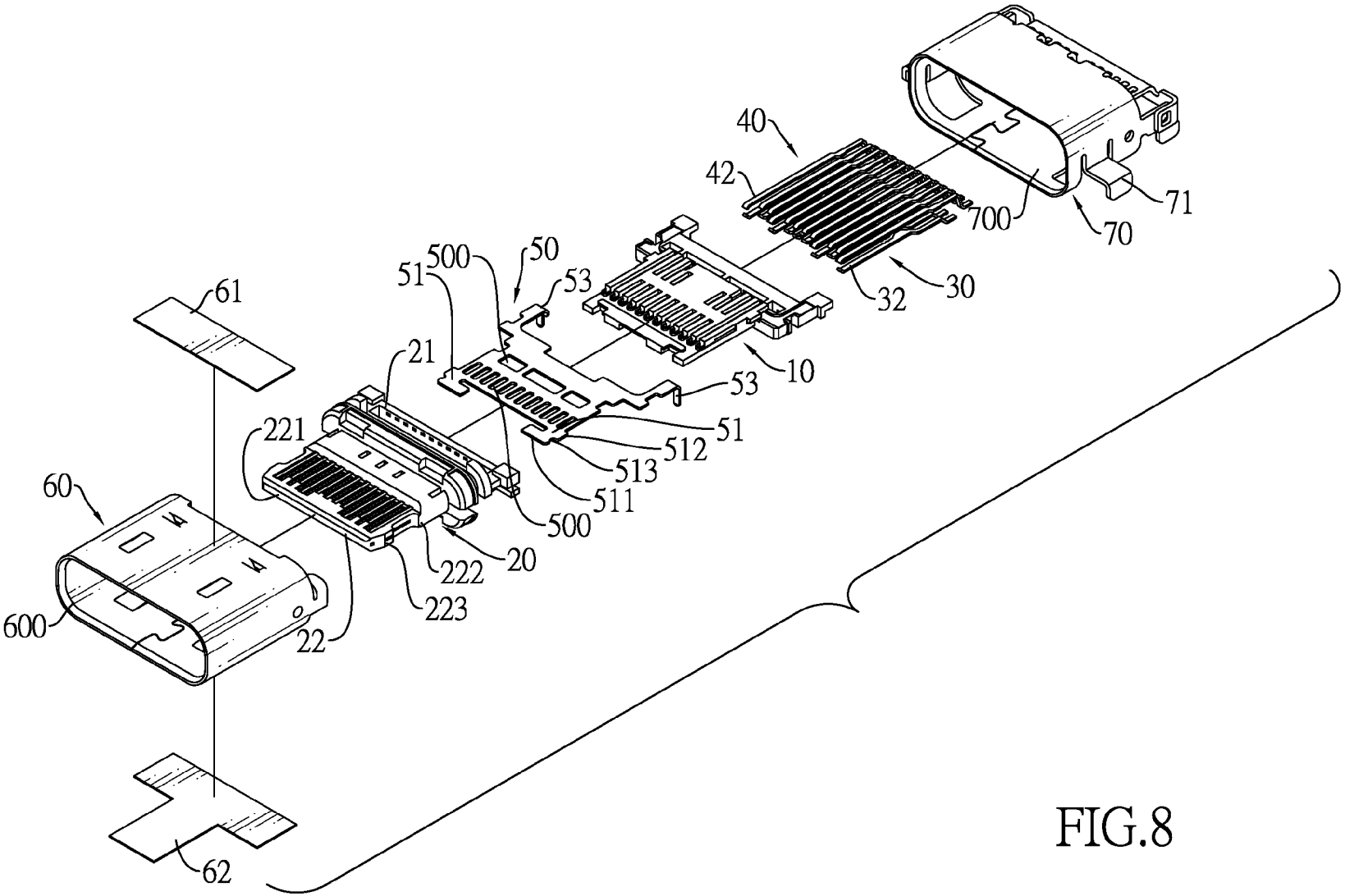
FIG. 8 is an exploded perspective view of the reinforced electrical receptacle connector in FIG. 1.

With reference to FIGS. 1 and 8, a reinforced electrical receptacle connector in accordance with the present invention comprises an insulated housing, a first terminal set, a second terminal set, a shielding plate 50, a shell 60 and a reinforced sleeve 70.

Figure 4:
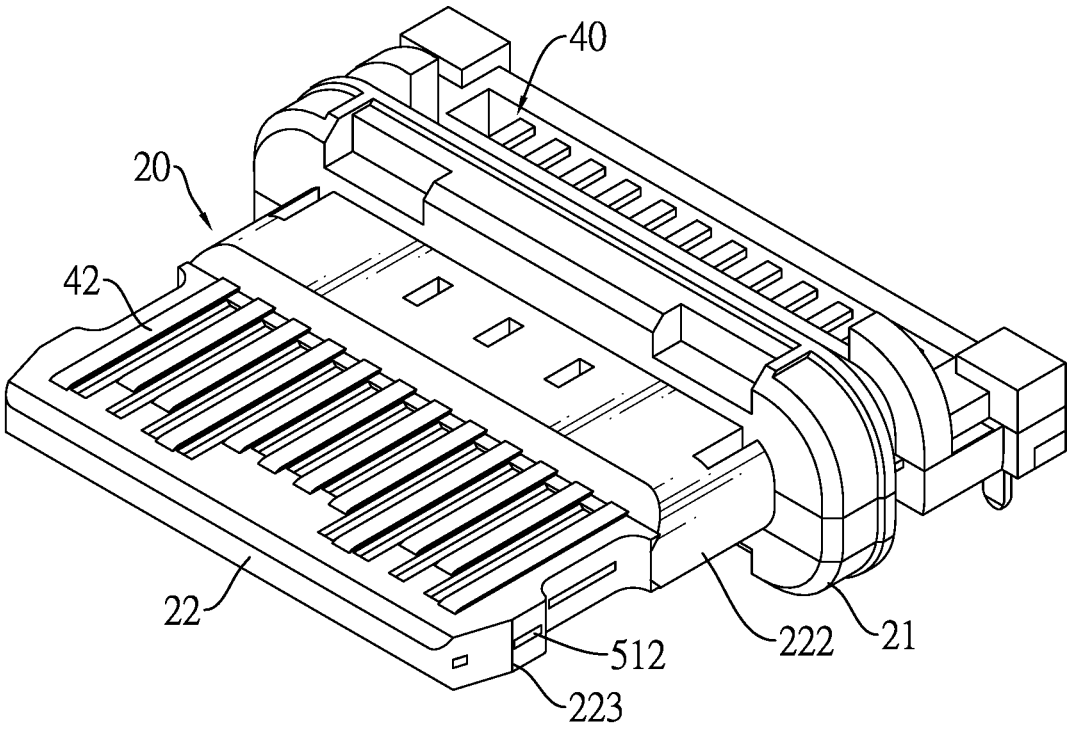
FIG. 4 is a perspective view of the reinforced electrical receptacle connector in FIG. 2 further omitting a shell.

With further reference to FIG. 4, the insulated housing has an inner insulative housing 10 and an outer insulative housing 20.

The outer insulative housing 20 is mounted on the inner insulative housing 10 and has a base 21 and a tongue 22.

The tongue 22 is formed on and protrudes forward from a front end of the base 21 and has a front edge 221, two opposite outside edges 222 and two front corners. Each front corner is defined between the front edge 221 and one outside edge 222.

Figure 5:
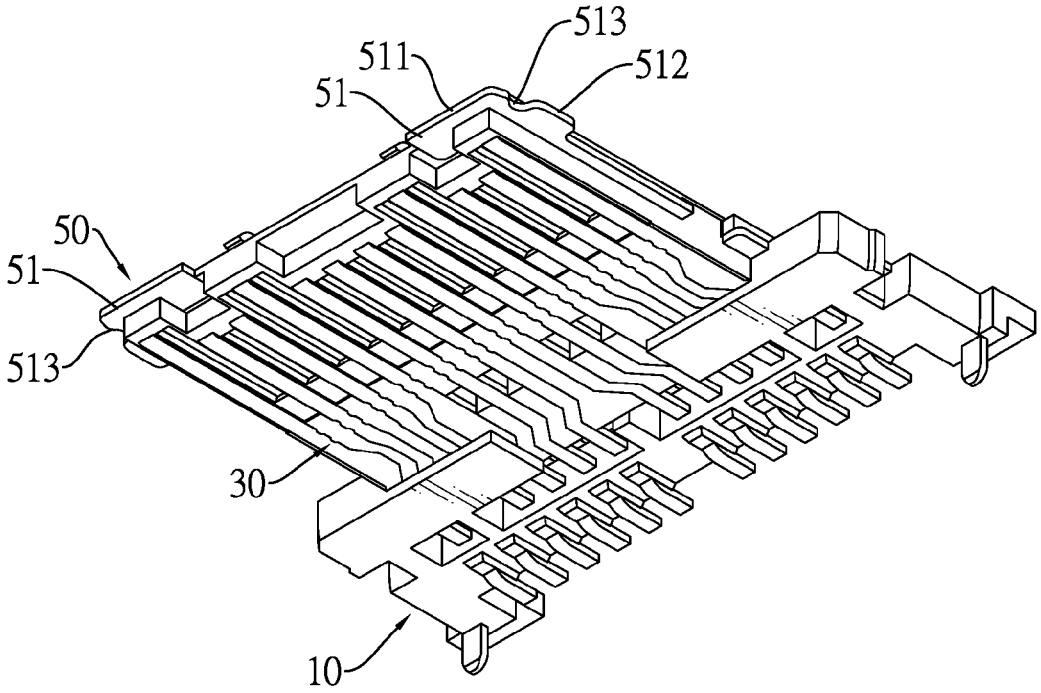
FIG. 5 is another perspective view of the reinforced electrical receptacle connector in FIG. 2 further omitting the shell.
Figure 9:
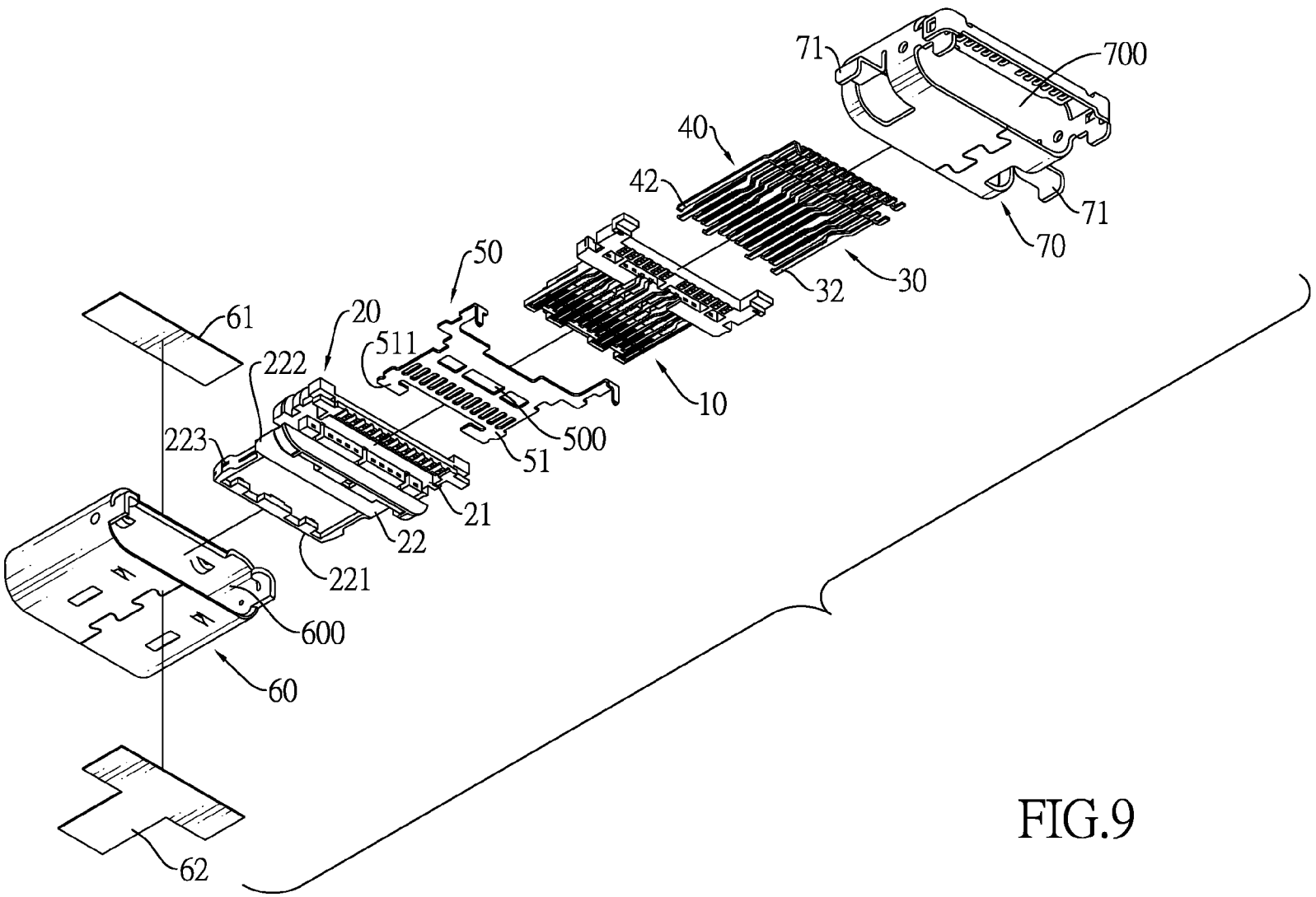
FIG. 9 is another exploded perspective view of the reinforced electrical receptacle connector in FIG. 1.

With further reference to FIGS. 5 and 9, the first terminal set is mounted in the insulated housing, may be mounted in the inner insulative housing 10 and has multiple first terminals 30. Each first terminal 30 is mounted in the insulated housing, may be mounted in the inner insulative housing 10 and has a first electrical contacting section 32 formed on a front end of the first terminal 30 and mounted on a bottom surface of the tongue 22 of the outer insulative housing 20.

Figure 6:
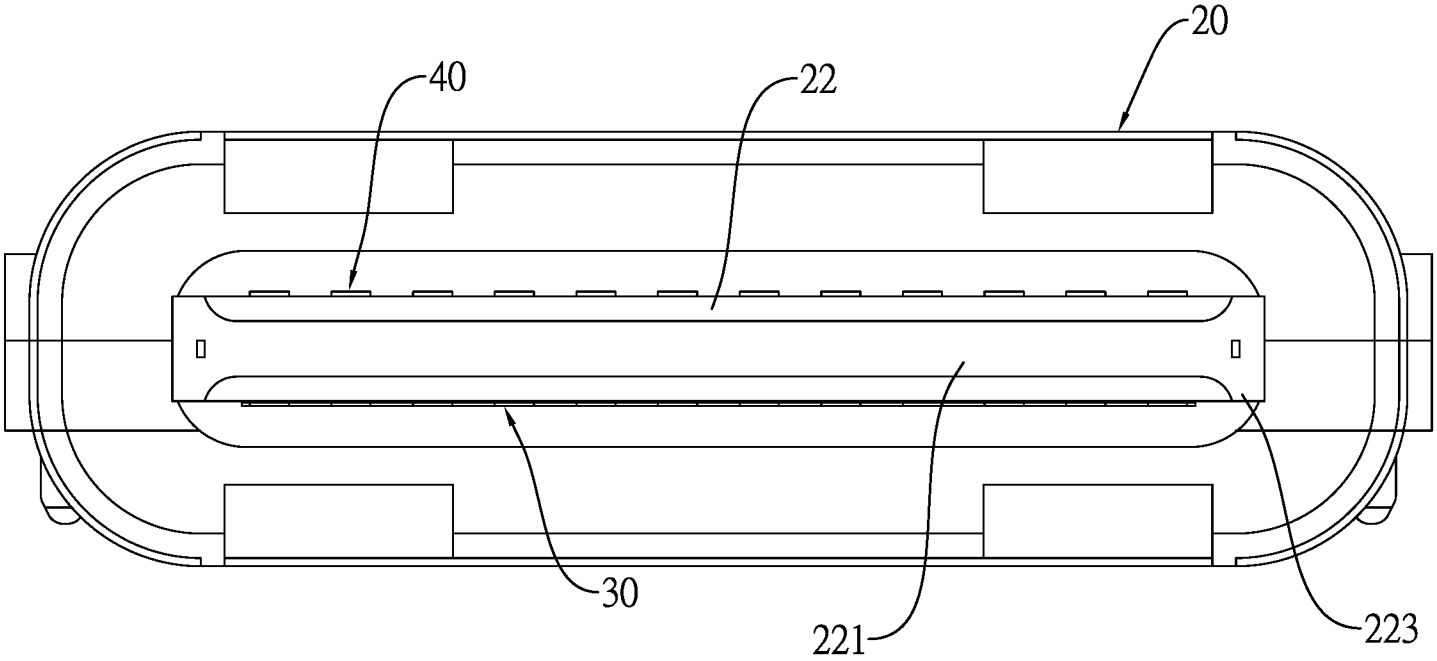
FIG. 6 is a perspective view of an inner insulative housing, a shielding plate and a first terminal set of the reinforced electrical receptacle connector in FIG. 1.
Figure 10:
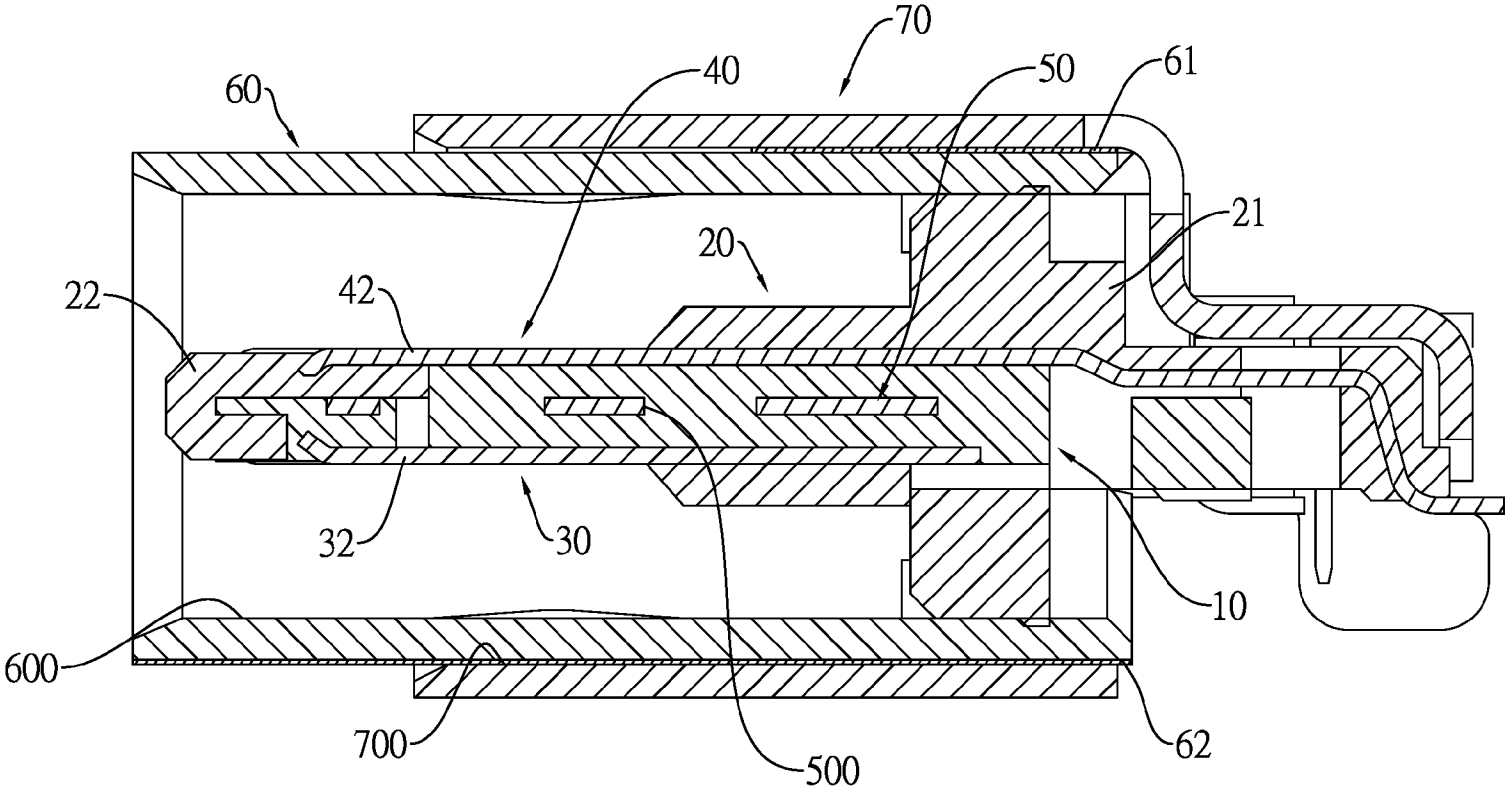
FIG. 10 is a cross sectional side view of the reinforced electrical receptacle connector in FIG. 1.

With further reference to FIGS. 6 and 10, the second terminal set is mounted on the insulated housing, may be mounted on the outer insulative housing 20 and has multiple second terminals 40. Each second terminal 40 has a second electrical contacting section 42 formed on a front end of the second terminal 40 and mounted on a top surface of the tongue 22 of the outer insulative housing 20.

Furthermore, the first terminal set and the second terminal set are substantially pointing symmetrical to each other with respect to a centre of symmetry of the tongue 22. According to point symmetrical configuration of the first and second terminal sets, when the first and second terminal sets are rotated for 180 degrees with respect to the centre of symmetry, the rotated first and second terminal sets coincide with and are identical to the first and second terminal sets without rotation of 180 degrees. By the point symmetrical configuration of the first and second terminal sets, an electrical plug connector can extend reversely into the reinforced electrical receptacle connector to normally implement high speed signal transmission.

Figure 7:
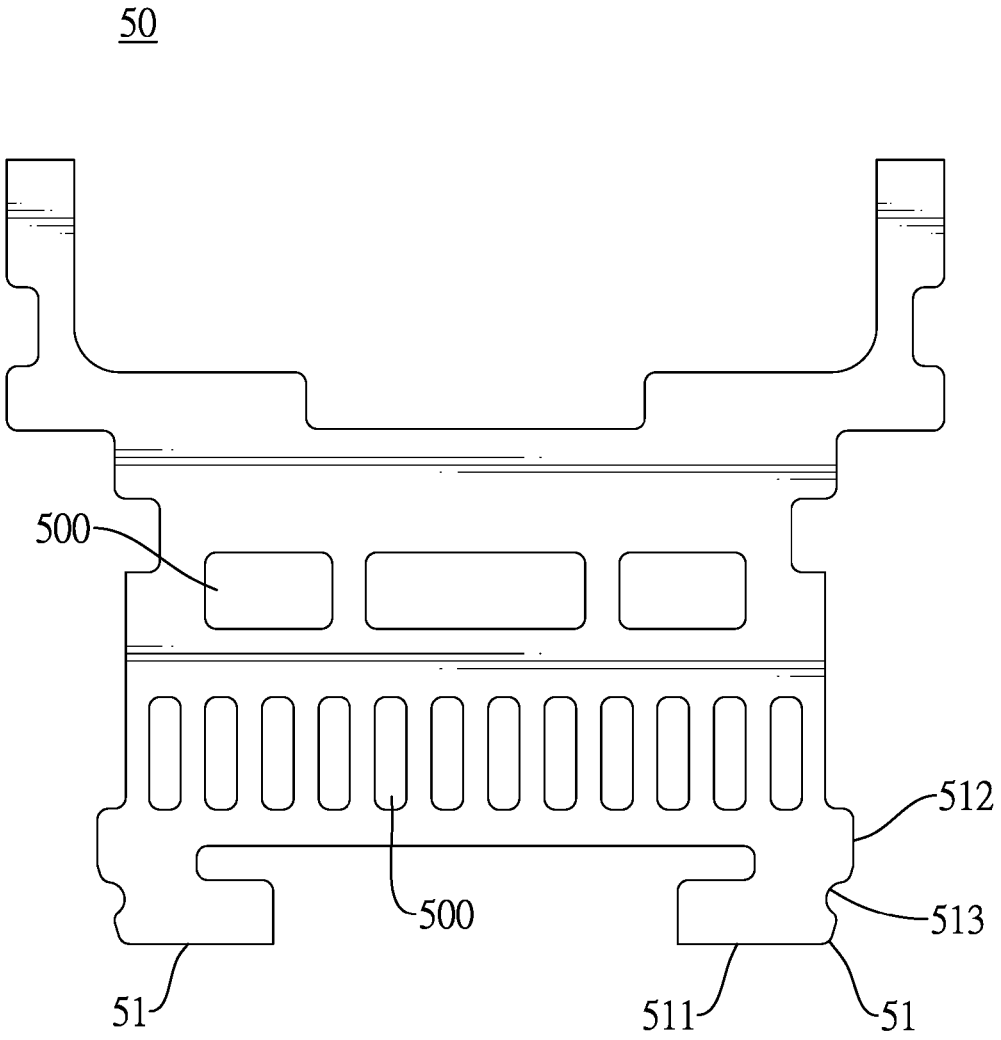
FIG. 7 is a front view of the shielding plate of the reinforced electrical receptacle connector in FIG. 1.
Figure 11:
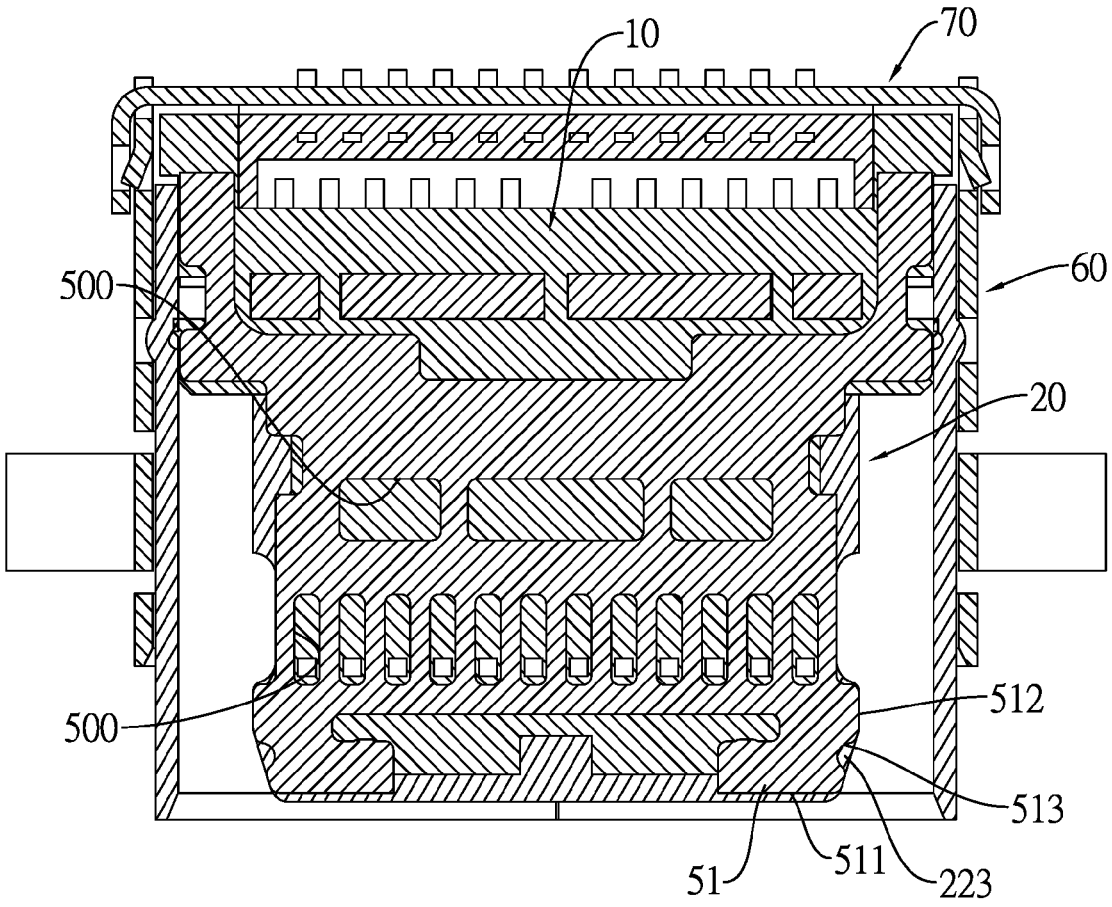
FIG. 11 is a cross section top view of the reinforced electrical receptacle connector in FIG. 1.

With further reference to FIGS. 7 and 11, the shielding plate 50 is made of metal, is embedded in the insulated housing, may be embedded in the inner insulative housing 10, may be embedded in the outer insulative housing 20 and has two front corners, two corner reinforcing tabs 51 and multiple receiving holes 500.

The front corners of the shielding plate 50 are substantially hidden in the front corners of the tongue 22.

The corner reinforcing tabs 51 are formed on respectively on the front corners of the shielding plate 50 and each corner reinforcing tab 51 has a front edge 511, an outside edge 512 and an embedding notch 513. The front edge 511 of the corner reinforcing tab 51 is flush with the front edge 221 of the tongue 22. The outside edge 512 of the corner reinforcing tab 51 is flush with one of the outside edges 222 of the tongue 22. The embedding notch 513 is defined between the front edge 511 and the outside edge 512 and accommodates an internal portion of one front corner of the tongue 22.

The receiving holes 500 are defined through the shielding plate 50 and respectively receive portions of the inner insulative housing 10.

Figure 2:
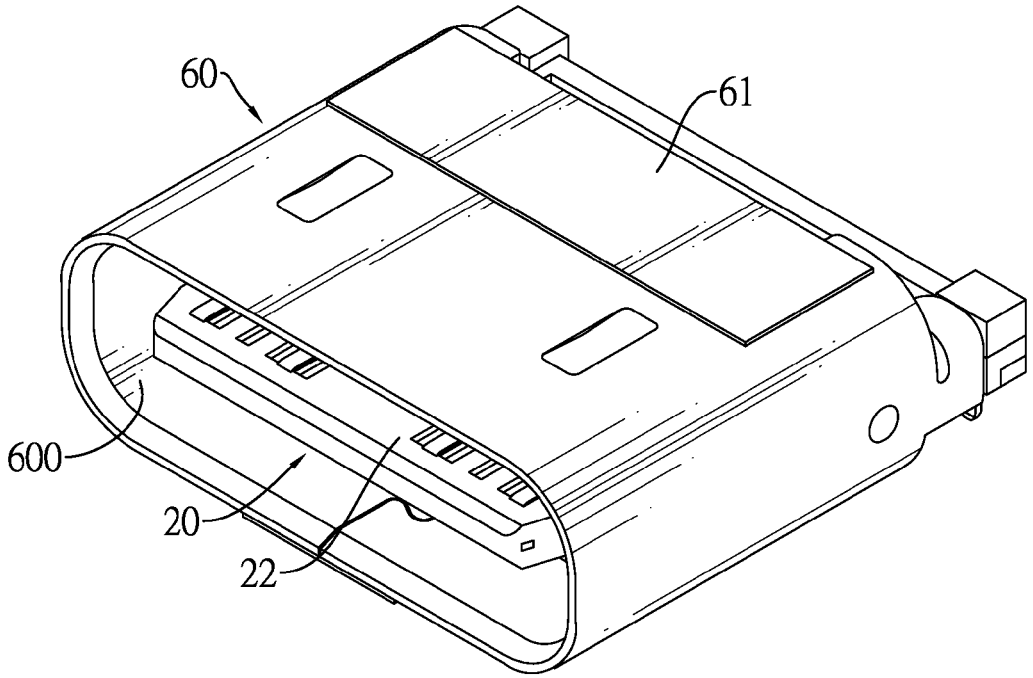
FIG. 2 is a perspective view of the reinforced electrical receptacle connector in FIG. 1 omitting a reinforced sleeve.
Figure 3:
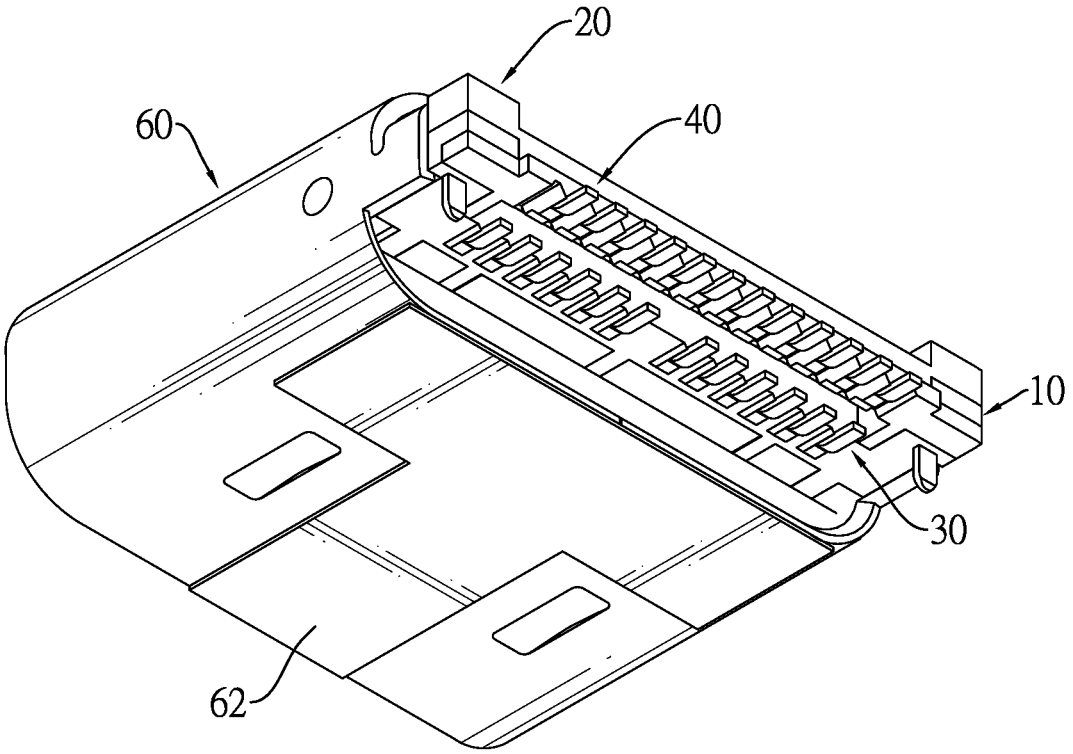
FIG. 3 is another perspective view of the reinforced electrical receptacle connector in FIG. 1 omitting the reinforced sleeve.

With further reference to FIGS. 2 and 3, the shell 60 has a cavity 600, a top insulating board 61 and a bottom insulating board 62.

The cavity 600 is defined in the shell 60 and accommodates the inner insulative housing 10, the outer insulative housing, 20, the first terminal set and the second terminal set.

The top insulating board 61 is mounted on a top of the shell 60 and performs insulating and water-proof functions.

The bottom insulating board 62 is mounted on a bottom of the shell 60 and performs insulating and water-proof functions.

The reinforcing sleeve 70 has an accommodating space 700 and two mounting legs 71.

The accommodating space 700 is defined in the reinforcing sleeve 70, accommodates the shell 60 and locates the top insulating board 61 and the bottom insulating board 62 between the shell 60 and the reinforcing sleeve 70.

The mounting legs 71 are formed on and protrude respectively from two opposite sides of the reinforcing sleeve 70 and may be mounted in mounting holes of a printed circuit board.

In the manufacture of the reinforced electrical receptacle connector, the first terminal set and the shielding plate 50 are assembled on the inner insulative housing 10 by a first insert-molding process. The combined first terminal set, shielding plate 50 and inner insulative housing 10 are further mounted on the outer insulative housing 20 by a second insert-molding process.

The shielding plate 50 embedded in the inner insulative housing 10 and the outer insulative housing 20 reinforces the structure of tongue 22 of the outer insulative housing. Furthermore, the embedding notches 513 accommodate internal portions of one front corner of the tongue 22. Therefore, the portion of the front corner of the tongue 22 are continuously from one outside edge to the front edge without being interrupted, which to enhances structural strength of the front corners of the tongue 22. Furthermore, the front corners of the shielding plate 50 are substantially hidden in the front corners of the tongue 22, which prevents inadvertent rupture at the front corners.

Therefore, the entire strength of the tongue 22 is improved and the durability for repeated engagement and disengagement of the reinforced electrical receptacle connector is increased. Thus, the lifespan of the reinforced electrical receptacle connector are prolonged.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A electrical receptacle connector comprising:

an insulated housing having a base; and a tongue formed on and protruding forward from a front end of the base and having a front edge, two opposite lateral edges and two front corners;

a first terminal set mounted in the insulated housing and having multiple first terminals, each first terminal having a first electrical contacting section formed on a front end of the first terminal and mounted on a bottom surface of the tongue;

a second terminal set mounted on the insulated housing and having multiple second terminals, each second terminal having a second electrical contacting section formed on a front end of the second terminal and mounted on a top surface of the tongue, wherein the first terminal set and the second terminal set are substantially pointing symmetrical to each other with respect to a centre of symmetry of the tongue;

a shielding plate embedded in the insulated housing and having two front corners substantially hidden in the front corners of the tongue; and two corner reinforcing tabs formed respectively on the front corners of the shielding plate and each corner reinforcing tab having a front edge being flush with the front edge of the tongue;

a lateral edge being flush with one of the lateral edges of the tongue; and an embedding notch defined between the front edge and the lateral edge of the corner reinforcing tab and accommodating an internal portion of one front corner of the tongue; and a shell having a cavity defined in the shell and accommodating the insulated housing, the first terminal set and the second terminal set.

2. The electrical receptacle connector as claimed in claim 1, wherein the insulated housing has an inner insulative housing; and an outer insulative housing mounted on the inner insulative housing and has the tongue and the base; and the shielding plate is embedded in the inner insulative housing and is embedded in the outer insulative housing.

3. The electrical receptacle connector as claimed in claim 2, wherein the shielding plate has multiple receiving holes defined through the shielding plate and respectively receiving portions of the inner insulative housing.

4. The electrical receptacle connector as claimed in claim 3, wherein the first terminal set and the shielding plate are assembled on the inner insulative housing by a first insert-molding process.

5. The electrical receptacle connector as claimed in claim 4, wherein after the first insert-molding process, the first terminal set, the shielding plate and the inner insulative housing are further mounted on the outer insulative housing by a second insert-molding process.

6. The electrical receptacle connector as claimed in claim 5, further comprising a reinforcing sleeve having an accommodating space defined in the reinforcing sleeve.

7. The electrical receptacle connector as claimed in claim 6, wherein the reinforcing sleeve further has two mounting legs formed on and protruding respectively from two opposite sides of the reinforcing sleeve.

8. The electrical receptacle connector as claimed in claim 7, wherein the shell further has a top insulating board mounted on a top of the shell and located between the shell and the reinforcing sleeve; and a bottom insulating board mounted on a bottom of the shell and located between the shell and the reinforcing sleeve.

* * * * *